US009556582B2

(12) United States Patent
Pelletier et al.

(10) Patent No.: US 9,556,582 B2
(45) Date of Patent: Jan. 31, 2017

(54) HOLLOW PLASTIC DECK BLOCK

(71) Applicants: Christian Pelletier, Saint-Antonin (CA); Nicolas Morneau, Saint-Antonin (CA)

(72) Inventors: Christian Pelletier, Saint-Antonin (CA); Nicolas Morneau, Saint-Antonin (CA)

( * ) Notice: Subject to any disclaimer, the term of this patent is extended or adjusted under 35 U.S.C. 154(b) by 0 days.

(21) Appl. No.: 14/998,892

(22) Filed: Feb. 29, 2016

(65) Prior Publication Data

US 2016/0258126 A1 Sep. 8, 2016

Related U.S. Application Data

(60) Provisional application No. 62/177,079, filed on Mar. 6, 2015.

(51) Int. Cl.

| | |
|---|---|
| ***E02D 27/42*** | (2006.01) |
| ***E02D 27/01*** | (2006.01) |
| ***E04H 12/22*** | (2006.01) |

(52) U.S. Cl.

CPC ..... *E02D 27/42* (2013.01); *E02D 27/01* (2013.01); *E04H 12/2238* (2013.01); *E02D 2300/0006* (2013.01)

(58) Field of Classification Search

CPC .. E02D 27/42; E02D 27/01; E02D 2300/0006; E02D 27/32; E04H 12/2238; E04H 12/2269; E04H 12/2292; E04H 12/22; E04H 17/263; E04H 12/34

USPC ..... 52/169.9, 263, 295, 296, 297, 298, 686,52/687

See application file for complete search history.

(56) References Cited

U.S. PATENT DOCUMENTS

| | | | | |
|---|---|---|---|---|
| 864,218 | A | 8/1907 | Woodruff | |
| 1,081,976 | A | 12/1913 | McCain | |
| 1,725,507 | A * | 8/1929 | Clement | E04F 11/1812 52/295 |
| 2,129,211 | A | 9/1938 | Hickl | |
| 2,522,149 | A | 9/1950 | Tunstall | |
| 3,302,909 | A | 2/1967 | Glassman | |
| 3,505,764 | A | 4/1970 | Cagigal Guttierrez | |
| 3,691,776 | A | 9/1972 | Hull | |
| 3,706,168 | A | 12/1972 | Pilish | |
| 4,026,086 | A | 5/1977 | Langley | |
| 4,328,651 | A | 5/1982 | Gutierrez | |
| 4,610,356 | A | 9/1986 | Porter et al. | |

(Continued)

FOREIGN PATENT DOCUMENTS

| | | |
|---|---|---|
| CA | 2690521 | 7/2011 |
| CH | 4-366215 | 12/1992 |
| FR | 946337 | 5/1949 |

*Primary Examiner* — Brian Glessner
*Assistant Examiner* — Adam Barlow
(74) *Attorney, Agent, or Firm* — Mario Theriault

(57) ABSTRACT

The deck block has is made of plastic by a roto-moulding process. The deck block has a truncated pyramidal shape with a flat top plane, a hollow center; a uniform wall thickness; a central vertical post socket and four joist slots extending horizontally from the post socket at a right angle with each other. The deck block has a multi-wall pillar therein extending between a bottom surface of the post socket and a bottom plane of the block. This pillar is made of four vertical hollow oval-shaped columns that are arranged in a circular array under the post socket for reinforcing the bottom surface of the post socket. In another aspect, the joist slots have protruding lips on each side thereof, for enlarging a top surface of the block and for reinforcing the joist slots.

20 Claims, 6 Drawing Sheets

(56) References Cited

U.S. PATENT DOCUMENTS

| | | | | | |
|---|---|---|---|---|---|
| 4,724,642 | A | * | 2/1988 | Hoffman | E02D 27/02 403/170 |
| 4,972,642 | A | * | 11/1990 | Strobl, Jr. | E02D 27/42 52/165 |
| 5,123,623 | A | * | 6/1992 | McNamara | E04H 12/2253 248/156 |
| 5,163,967 | A | | 11/1992 | Hoffman et al. | |
| 5,392,575 | A | | 2/1995 | Hoffman et al. | |
| D357,650 | S | | 4/1995 | Evans et al. | |
| 5,458,315 | A | | 10/1995 | Blatz et al. | |
| 5,560,171 | A | | 10/1996 | McCoy | |
| 5,560,588 | A | * | 10/1996 | Hilliard | E04H 12/2269 256/59 |
| 5,772,539 | A | * | 6/1998 | Hall | A63B 69/0013 473/499 |
| 5,953,874 | A | | 9/1999 | Hoffman et al. | |
| D440,022 | S | * | 4/2001 | Simpson | D34/31 |
| 6,324,801 | B1 | | 12/2001 | Holfman et al. | |
| 6,345,474 | B1 | * | 2/2002 | Triplett | E02D 27/01 405/229 |
| 7,040,603 | B1 | | 5/2006 | Tai | |
| 7,416,166 | B1 | | 8/2008 | Shaw | |
| 7,610,728 | B1 | | 11/2009 | Manocchia | |
| 7,798,920 | B1 | * | 9/2010 | Cortes | A63B 67/00 434/251 |
| 7,827,747 | B2 | | 11/2010 | George et al. | |
| D647,685 | S | | 10/2011 | Atkins | |
| 2007/0187564 | A1 | * | 8/2007 | McGuire | E02D 27/42 248/346.5 |
| 2012/0020746 | A1 | | 1/2012 | Astolfi et al. | |
| 2013/0125498 | A1 | * | 5/2013 | Lowery | E04C 5/203 52/677 |

* cited by examiner

HOLLOW PLASTIC DECK BLOCK

The present application claims the benefit of U.S. Provisional Application No. 62/177,079, filed Mar. 6, 2015.

FIELD OF THE PRESENT INVENTION

The present invention pertains to deck blocks, and more particularly, it pertains to lightweight deck blocks.

BACKGROUND OF THE PRESENT INVENTION

Conventional deck blocks are made of Portland cement and sand mix and weigh between 42 and 51 lbs., each depending on the dimensions of the manufacturing moulds. These blocks are sold on pallets and transported by flat bed transport trailers. These cement blocks are expensive to transport and difficult to manipulate by clients. Concrete deck blocks are displayed for sale outside, in the yard of a hardware store for example, and clients are expected to load the blocks themselves in their vehicles. Because conventional deck blocks are too heavy to be displayed inside a hardware store, these blocks are sold mostly to carpenters and landscape contractors, and remain generally unknown to the do-it-yourself market.

The load bearing capacity of these blocks is equivalent to the compressive strength of the cement mix, which varies between 3000-6000 psi, generally.

Conventional construction blocks are described in the following documents:

U.S. Pat. No. 2,522,149, issued to W. Tunstall on Sep. 12, 1950;

U.S. Pat. No. 3,706,168, issued to A. Pilish on Dec. 19, 1972;

U.S. Pat. No. 4,328,651, issued to M. Gutierrez on May 11, 1982;

U.S. Pat. No. 4,724,642, issued to P. Hoffman et al., on Feb. 16, 1988;

U.S. Pat. No. 5,163,967, issued to P. Hoffman et al., on Nov. 17, 1992;

U.S. Pat. No. 5,392,575, issued to P. Hoffman et al., on Feb. 28, 1995;

U.S. Pat. No. 5,560,171, issued to J. R. McCoy on Oct. 1, 1996;

U.S. Pat. No. 5,953,874, issued to P. Hoffman et al., on Sep. 21, 1999;

U.S. Pat. No. 6,324,801, issued to P. Hoffman et al., on Dec. 4, 2001;

U.S. Pat. No. 6,345,474, issued to D. Triplett on Feb. 12, 2002; U.S. Pat. No. 7,827,747, issued to G. R. George et al., on Nov. 9, 2010.

A lightweight cement block has been developed in a recent past. These lightweight blocks are manufactured and sold by Featherlight Precast Products, of 35 South Street, Hancock, Md., 21750, USA. These lightweight deck blocks weigh 16 lbs each, and are more appropriate for display inside a hardware store where they can be seen and purchased by homeowners and handymen. The load bearing capacity of these lightweight blocks is 1,760 pounds each.

Although the capacity of the lightweight block is not as much as the conventional Portland cement block, it is stronger than the load bearing capacity of most soils on which the block will be installed. Also, the selling of these lightweight blocks with spacing instructions makes more sense commercially, than selling a heavy conventional block that has a compressive strength which largely exceeds the requirement of the actual load to be supported.

In the light of the above, it also makes sense to consider the manufacturing of deck blocks using a material that is lighter than concrete, providing that the blocks have a load bearing capacity that is reasonable for the intended application. Therefore, it is believed that there is a market for a plastic deck block that can be displayed for sale inside a hardware store and easily carried to a vehicle and easily installed by a handy homeowner.

SUMMARY OF THE PRESENT INVENTION

In the present invention, there is provided a hollow plastic deck block that weighs less than 5 lbs., that has a 12.25 square inch base, and a load bearing capacity of 1,000 lbs.

In a first aspect of the plastic deck block according to the present invention, the block has a truncated pyramidal shape with a flat top plane, a hollow center; a uniform wall thickness; a central vertical post socket and four joist slots extending horizontally from the post socket at a right angle with each other. The deck block has a multi-wall pillar therein extending between a bottom surface of the post socket and a bottom plane of the block. This pillar is made of four vertical hollow oval-shaped columns that are arranged in a circular array under the post socket for reinforcing the bottom surface of the post socket, and for providing the aforesaid 1000 pounds of load bearing capacity.

In order to prevent any buckling in the vertical columns, the height of the columns is limited to three inches. The overall height of the block is limited to 5 inches. The base of the block is square with a side dimension of about 12 inches.

In other aspects of the deck block of the present invention, the central post socket has a chamfer there-around. The joist slots have protruding lips on each side thereof, and these lips are contiguous with the top plane of the block for enlarging a top surface of the block. The protruding lips contribute to reinforce the joist slots.

The deck blocks according to the present invention are made of plastic by a roto-moulding process. The blocks have a smooth surface. They can be dyed to different colours. The blocks can be handled by hand without glove. The blocks can be nested on top of each other for easy display inside a hardware store.

This brief summary has been provided so that the nature of the invention may be understood quickly. A more complete understanding of the invention can be obtained by reference to the following detailed description of the preferred embodiment thereof in connection with the attached drawings.

DETAILED DESCRIPTION OF THE PREFERRED EMBODIMENT

The preferred embodiment of the hollow plastic deck block according to the present invention is described herein below with reference to the attached drawings. The same numerals are used to illustrate the same elements.

Figure 1:
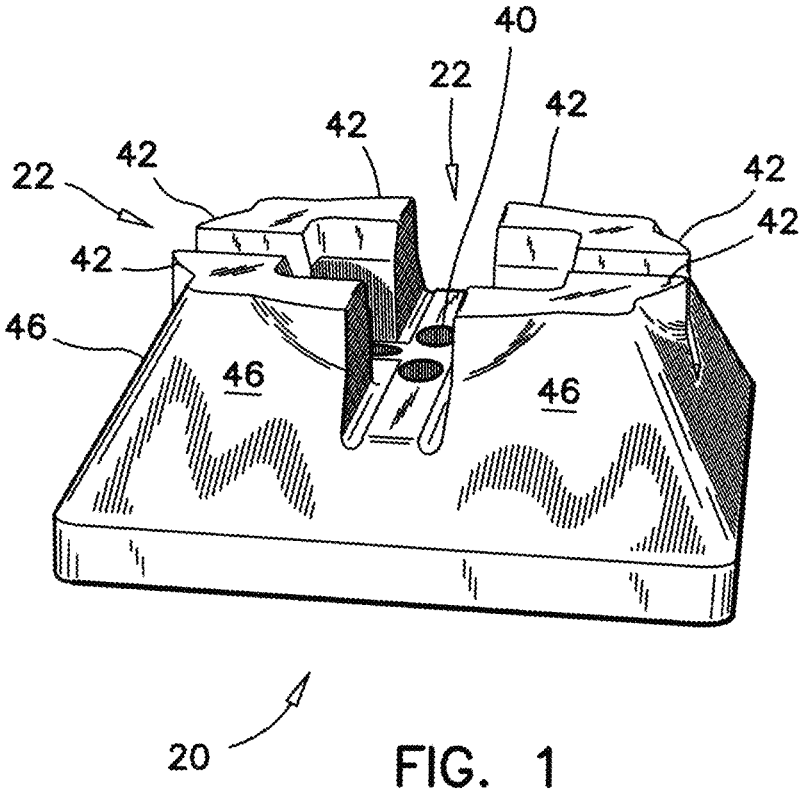
FIG. 1 is a perspective side and top view of the hollow plastic deck block according to the preferred embodiment of the present invention.
Figure 2:
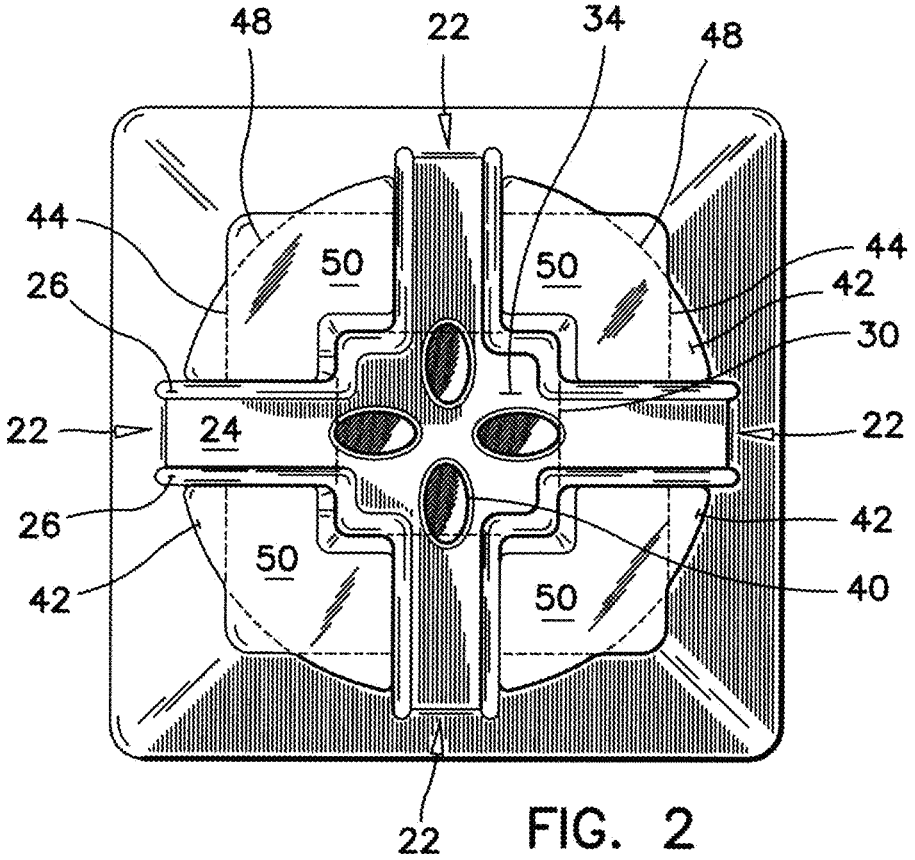
FIG. 2 is a top view of the hollow plastic deck block according to the preferred embodiment of the present invention.
Figure 3:
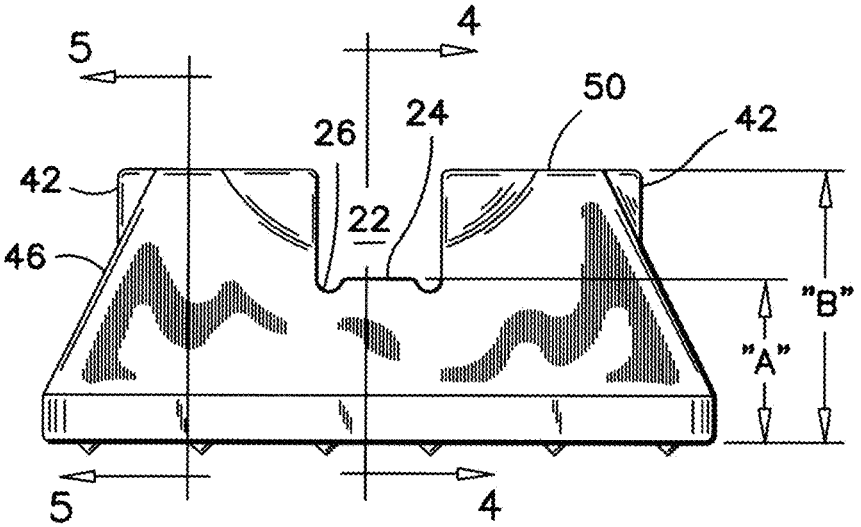
FIG. 3 is a side view of the preferred deck block.
Figure 4:
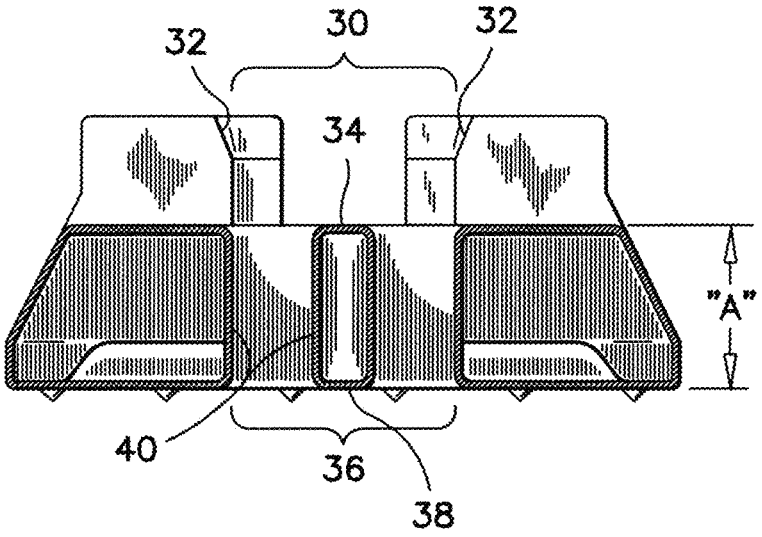
FIG. 4 is a cross-section view of the preferred deck block as seen along line 4-4 in FIG. 3.

Referring to FIG. 1, the overall arrangement of the preferred deck block is illustrated. In FIGS. 2-10, the elements of the preferred deck block are identified. The preferred deck block 20 has a square base and a pyramidal shape with a side dimension of about 12 inches. The preferred hollow plastic block 20 is preferably made of plastic by a roto-moulding process.

The preferred deck block 20 has four joist slots 22 extending horizontally at right angle from each other across the block 20, at a height "A" of about 3 inches from the plane of the base. The total height "B" of the preferred block 20 is about 5 inches. Each joist slot 22 has a joist support surface 24 between two drainage channels 26. The drainage channels 26 are deeper than the joist support surface 24. A first purpose of the drainage channels 26 is to evacuate water from the joist slots 22 and to prevent deterioration by moisture of the joists supported by the block 20. A second function of the drainage channels 26 is to add structural strength to the joist slots 22. A third function of the drainage channels 26 is to relieve any pressure on the square corners of a joist sitting in one of the joist slots 22.

The preferred block 20 has a post socket 30 at the center thereof. The post socket 30 has a generous chamfer 32 on its opening to facilitate the insertion of a post in the socket 30. The bottom surface 34 of the post socket 30 is a same elevation "A" as the joist support surfaces 24.

The bottom surface 34 of the post socket 30 has a multi-wall pillar 36 extending therefrom to the base plane 38 of the block 20. The multi-wall pillar 36 is preferably made of four holes 40 having a preferred oval cross-section. Each of the oval cross-section preferably has an area of about 0.848 square inch. These four holes 40 are placed in a circular array, each aligning with the longitudinal axis of one of the joist slots 22. It will be appreciated that the array of oval holes 40 constitute four columns inside the block 20, extending between the bottom surface 34 of the post socket 30 to the base 38 of the block 20. These four columns 40 which can be seen in FIGS. 4 and 8, reinforce the post socket 30, such that the post socket 30 can support a substantial load. Laboratory tests have demonstrated that the bottom surface 34 of the post socket 30 can support a load of 1000 lbs.

Referring now to FIGS. 1-3, 5, 7 and 9, another characteristic of the preferred deck block 20 will be described. The joist slots 22 have protruding lips 42 relative to the projections 44 of the top corners of the block 20, and relative to the side surfaces 46 of the block. In a top view of the block 20, in FIG. 2, the enlarged lips 42 are defined by a circle 48 which can be seen in dashed lines. These enlarged lips 42 provide strength to the joist slots 22 and add surface and structural strength to each of the four top surfaces 50 of the block 20. Such enlarged top surfaces 50 are advantageous for supporting a piece of lumber on its side, as this is often the case during the fine-levelling of a deck.

Figure 7:
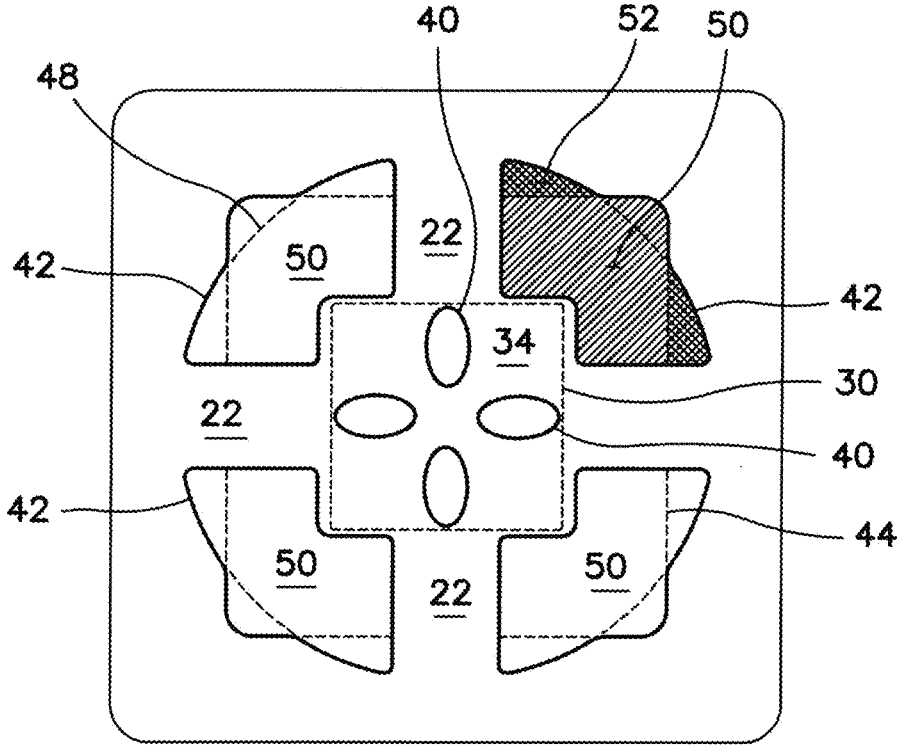
FIG. 7 is a partial top view of the preferred deck block showing the top supporting surfaces thereof.
Figure 8:
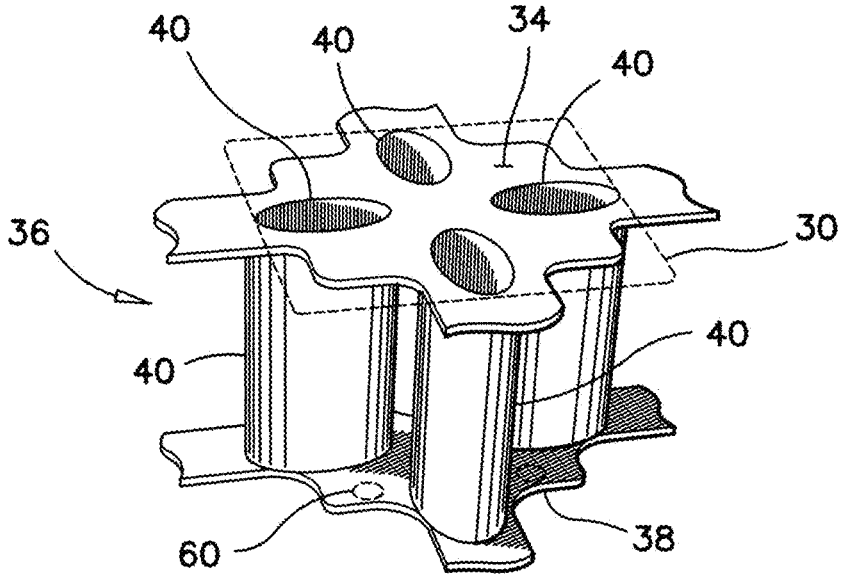
FIG. 8 is a partial perspective view of the pillar under the post socket of the preferred deck block.
Figure 9:
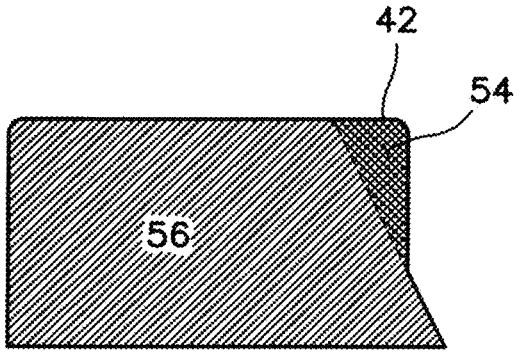
FIG. 9 is a partial elevation view of the side surface in one of the joist slot of the preferred deck block.

Referring particularly to FIGS. 7 and 9, the upper surfaces 52 of the protruding lips 42 add 17.5% area to each of the top surfaces 50 of the block 20. Similarly, the side surface 54 of each lip 42 add 7% to a side surface 56 of each joist slot 22. This added surface 54 contributes to reinforce each joist slot 22 against deformation to prevent a joist from tilting.

Figure 6:
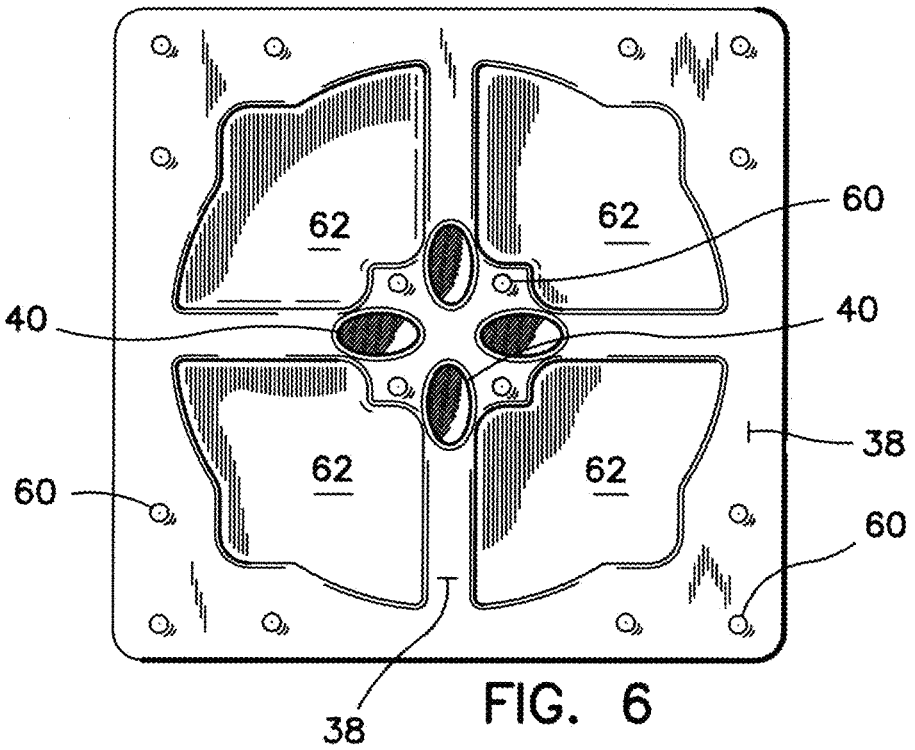
FIG. 6 is a bottom view of the preferred deck block.

The bottom surface of the base of the preferred block 20 has several conical protrusions 60 thereon, for holding the block in place on the ground. As can be seen in FIG. 6, the protrusions 60 are equally spaced apart around the outside edge of the bottom surface and also between the oval-shaped columns 40 under the post socket 30.

Figure 5:
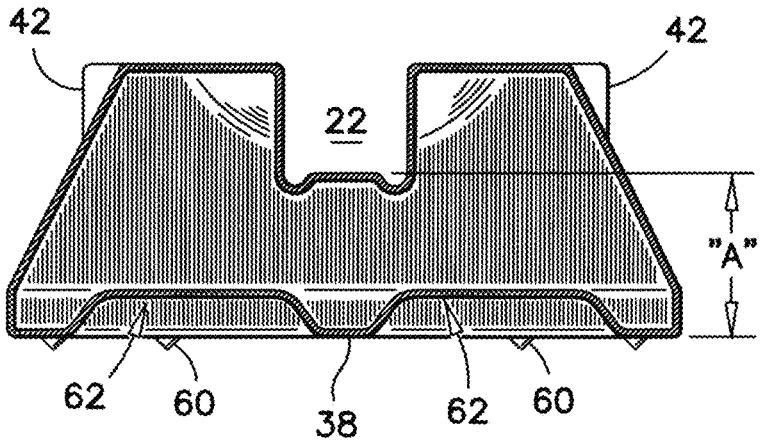
FIG. 5 is another cross-section view of the preferred deck block as seen along line 5-5 in FIG. 3.
Figure 10:
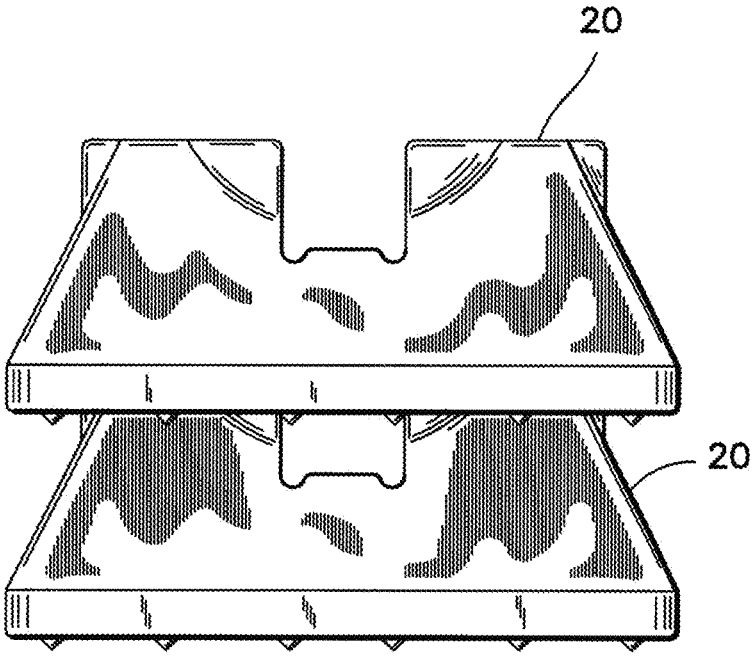
FIG. 10 illustrates two deck blocks, one nested on top of another.

Referring now to FIGS. 5 and 6, the bottom surface 38 of each block 20 has four cavities 62 therein. The shape and placement of these cavities 62 correspond to the shape and placement of the four top surfaces 50 of the block 20. As may be understood, the preferred block 20 can be stacked on top of another block 20, as illustrated in FIG. 10, by mating the top surfaces 50 of one block into the base cavities 62 of another block. The base cavities 62 also contribute to reinforcing the bottom surface of the block 20, and to retain the block 20 in place against sliding on a soft ground surface.

Although the preferred block 20 has reinforcing features under the post socket 30, along each of the joist slots 22, on the top surfaces 50 adjacent to the joist slots 22 and on the bottom surface of the block 20, the entire block can be moulded of plastic with a uniform wall thickness, by a roto-moulding process. It's outside surface is smooth and its weight is one tenth of the conventional Portland cement deck block.

What is claimed is:

1. A plastic deck block having a truncated pyramidal shape with a flat top plane, side surfaces; a hollow center; a uniform wall thickness; a central post socket and four joist slots extending horizontally from said post socket at a right angle with each other; further comprising:

a multi-wall pillar extending vertically between a bottom surface of said post socket and a bottom plane of said pyramidal shape, for reinforcing said bottom surface of said post socket;

said multi-wall pillar comprising four hollow columns each having an oval cross-section , and wherein said hollow columns being disposed in a circular array under said bottom surface of said post socket, and each of said hollow columns having said oval cross-section aligned with a longitudinal axis of one of said joist slots.

2. The plastic deck block as claimed in claim 1, having a total height of about 5 inches and each of said columns having a height of about 3 inches.

3. The plastic block as claimed in claim 1, wherein said central post socket has a chamfer there-around.

4. The plastic block as claimed in claim 1, wherein each of said joist slots intersects one of said side surfaces of said pyramidal shape along a pair of parallel intersection lines, and each of said joist slot has a lip along each of said intersection lines; said lips being raised relative to said one of said side surfaces of said pyramidal shape.

5. The plastic block as claimed in claim 1, further comprising a plurality of conical protrusions extending from said bottom plane thereof.

6. A plastic deck block having a truncated pyramidal shape with a flat top surface, side surfaces, a bottom base plane, a hollow center; a central post socket and four joist slots extending horizontally from said post socket at right angle with each other; further comprising:

a multi-wall pillar extending vertically between a bottom surface of said post socket and said bottom base plane of said pyramidal shape, for reinforcing said bottom surface of said post socket: said multi-wall pillar comprising four hollow columns each having an oval cross-section , and wherein said hollow columns being disposed in a circular array under said bottom surface of said post socket, and each of said hollow columns having said oval cross-section thereof aligned with a longitudinal axis of one of said joist slots: and each of said joist slots intersecting one of said side surfaces of said pyramidal shape along a pair of parallel intersection lines, and said joist slot having a lip along each of said intersection lines: said lips being raised relative to said one of said side surfaces of said pyramidal shape.

7. The plastic deck block as claimed in claim 6, wherein each of said lips having a top segment being contiguous with said top surface, enlarging said top surface.

8. The plastic deck block as claimed in claim 7, wherein said bottom base plane has a plurality of conical protrusions thereon.

9. The plastic deck block as claimed in claim 6, wherein each of said joist slots having drainage channels therein.

10. The plastic block as claimed in claim 6, wherein said central post socket has a chamfer there-around.

11. The plastic block as claimed in claim 6, having a uniform wall thickness.

12. A first and second plastic deck blocks each having a truncated pyramidal shape, a flat top plane, a flat bottom plane, a hollow center;

a uniform wall thickness; a central post socket and four joist slots extending horizontally from said post socket at right angle with each other; said central post socket in each of said plastic blocks having four holes extending between a bottom surface of said post socket and said bottom plane;

said top plane being made of four raised surfaces defined by said four joist slots and said central post socket; said bottom plane having four cavities therein corresponding in shape and placement to said four raised surfaces; such that said raised surfaces of said first plastic block being nestable into said four cavities in said bottom plane of said second plastic block.

13. The first and second plastic blocks as claimed in claim 12, further comprising a plurality of conical protrusions extending from said bottom plane.

14. The first and second plastic blocks as claimed in claim 12, wherein each of said joist slots having drainage channels therein.

15. The first and second plastic blocks as claimed in claim 12, further comprising lips on an outside portion of each of said joist slots;

said lips protruding from a side surface of said pyramidal shape for reinforcing said joist slots; each of said lips having a top segment being contiguous with one of said top surfaces, and enlarging said top surface.

16. The plastic block as claimed in claim 1, wherein each of said oval cross-section has a longer dimension aligned with said longitudinal axis of one of said joist slots.

17. The plastic block as claimed in claim 4, wherein each of said lips being contiguous with said top plane.

18. The plastic block as claimed in claim 4 , wherein each of said lips being defined by an arc along a perimeter of said flat top plane and a curved surface on said side surface of said pyramidal shape; said curved surface being raised from said side surface and contiguous with said arc.

19. The plastic block as claimed in claim 18, wherein a perimeter of said top plane being defined by the intersection of a square and a circle, wherein a diameter of said circle being larger than a side of said square; and wherein segments of said circle bordering each of said joist slots forming said arcs and each of said curved surfaces being defined by a projection of one of said arcs vertically downward intersecting one of said side surfaces of said pyramidal shape.

20. The plastic block as claimed in claim 6, wherein each of said lips being defined by an arc along a perimeter of said flat top plane and a curved surface on said side surface of said pyramidal shape; said curved surface being raised from said side surface and contiguous with said arc, and wherein a perimeter of said, top plane being defined by an intersection of a square and a circle, wherein a diameter of said circle being larger than a side of said square, and segments of said circle bordering each of said joist slots forming said arcs and each of said curved surfaces being defined by a projection of one of said arcs vertically downward intersecting one of said side surfaces of said pyramidal shape.

* * * * *